US008931862B2

(12) United States Patent
Grimm

(10) Patent No.: US 8,931,862 B2
(45) Date of Patent: Jan. 13, 2015

(54) DRAWER

(71) Applicant: Julius Blum GmbH, Hochst (AT)

(72) Inventor: Matthias Grimm, Altach (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 14/177,526

(22) Filed: Feb. 11, 2014

(65) Prior Publication Data

US 2014/0184047 A1 Jul. 3, 2014

Related U.S. Application Data

(63) Continuation of application No. PCT/AT2012/000164, filed on Jun. 8, 2012.

(30) Foreign Application Priority Data

Aug. 30, 2011 (AT) ..... 1234/2011

(51) Int. Cl.
*A47B 88/00* (2006.01)
*A47B 88/04* (2006.01)

(52) U.S. Cl.
CPC ..... *A47B 88/04* (2013.01); *A47B 88/0044* (2013.01)
USPC ..... 312/348.2; 312/348.4

(58) Field of Classification Search
CPC ..... A47B 88/0055; A47B 88/0014; A47B 88/0044; A47B 88/0051; A47B 2210/02
USPC ..... 312/330.1, 348.1, 348.2, 348.4, 257.1, 312/263
See application file for complete search history.

(56) References Cited

U.S. PATENT DOCUMENTS

| | | | | |
|---|---|---|---|---|
| 3,752,553 | A | 8/1973 | Bildahl et al. | |
| 4,230,382 | A * | 10/1980 | Wenzlick et al. | 312/265.1 |
| 4,440,460 | A * | 4/1984 | Brighoff | 312/348.4 |
| 5,348,386 | A * | 9/1994 | Grass | 312/348.2 |
| 5,895,103 | A * | 4/1999 | Huber | 312/348.4 |

FOREIGN PATENT DOCUMENTS

| | | |
|---|---|---|
| DE | 1 809 159 | 6/1970 |
| DE | 2 316 328 | 10/1974 |
| DE | 195 10 119 | 9/1996 |
| DE | 20 2005 004 819 | 8/2006 |

(Continued)

OTHER PUBLICATIONS

International Search Report (ISR) issued Sep. 27, 2012 in International (PCT) Application No. PCT/AT2012/000164.

(Continued)

*Primary Examiner* — James O Hansen
(74) *Attorney, Agent, or Firm* — Wenderoth, Lind & Ponack, L.L.P.

(57) ABSTRACT

A drawer with a first wall part, a second wall part, and a fixing device, via which the first wall part and the second wall part can be connected to each other. The fixing device has at least one locking element for locking the wall elements to each other. The locking element has at least one tongue, which is spring-elastic in particular and which can be inserted into a recess of one of the wall parts and fixed in the recess, in particular in a clamped manner. The locking element is substantially designed in a comb-like manner in which two or more tongues that are spaced from one another in the longitudinal direction of a connecting piece project laterally from the connecting piece.

13 Claims, 7 Drawing Sheets

(56) References Cited

FOREIGN PATENT DOCUMENTS

| | | |
|---|---|---|
| DE | 20 2008 009 396 | 12/2009 |
| GB | 1 431 046 | 4/1976 |
| GB | 1 522 598 | 8/1978 |
| GB | 2 101 879 | 1/1983 |
| WO | 03/024274 | 3/2003 |
| WO | 2009/111807 | 9/2009 |

OTHER PUBLICATIONS

Austrian Patent Office Search Report (ASR) issued Apr. 24, 2012 in Austrian Patent Application No. A 1234/2011.

* cited by examiner

DRAWER

BACKGROUND

The present invention relates to a drawer comprising a first wall portion and a second wall portion, and a fixing device, by way of which the first wall portion and the second wall portion can be connected together, wherein the fixing device has at least one arresting element for arresting the wall elements relative to each other, wherein the arresting element has at least one, in particular spring-elastic, tongue which can be introduced into an opening in one of the wall portions and can be fixed therein—in particular in clamping relationship.

The invention further concerns an article of furniture comprising at least one drawer of the kind to be described.

A drawer of the general kind set forth is described for example in WO 2009/111807 A1 to the present applicant, wherein two wall portions can be secured relative to each other after they have been positioned relative to each other by a gripping element of a fixing device. In the embodiment shown in FIGS. 6-8 of WO 2009/111807 there is a holding device with push-in pins which can be pushed into guide passages of a wall element. Relatively many components are necessary for that structure while in addition a considerable manual force has to be applied for tightening the gripping element depending on the respective tolerance situation.

GB 1 431 046 A and GB 1 522 598 A each describe fitments for connecting two drawer wall portions, wherein resilient hooks of the fitments can be introduced into openings in a wall portion and latched in corresponding openings there. Those hooks require on the one hand a large amount of structural space while on the other hand the wall portions have to be provided with corresponding openings.

SUMMARY

The object of the present invention is to provide a drawer of the general kind set forth in the opening part of this specification, wherein the fixing device for arresting the two wall elements is of a simple, inexpensive and robust structure and permits reliable fixing of the two wall portions relative to each other.

According to the invention it is therefore provided that the arresting element is substantially of a comb-like configuration, wherein two or more tongues spaced in the longitudinal direction of a bar portion project laterally from the bar portion.

By virtue of the—preferably spring-elastic—tongues they can be pushed into the opening in a wall portion, in which case those tongues are held in force-locking relationship within the opening by bearing against a flank of the opening. In that case the tongues are arranged on one of the wall portions and can be pushed into the opening provided in the other wall portion. In that case the opening in the wall portion can be in the form of a groove extending in the longitudinal extent of the wall portion, in which case the tongues can be pushed into the groove at an end of the wall portion and are fixed or can be fixed therein by clamping. In the rest condition the tongues project outwardly beyond the edge of the opening and upon being pushed in—preferably in opposite relationship to the spring force of the tongues—they can be bent into the opening, in which case the tongues are held in self-arresting relationship by constantly bearing against a flank of the opening.

In an embodiment it can be provided that at least one tongue has a longitudinal direction, the longitudinal direction of the tongue extending inclinedly relative to a longitudinal extent of the opening. In that way, the free end of the tongue forms a kind of barb which engages in claw-like relationship within the opening and the tongue is prevented from being undesirably pulled out.

The tongue can have a free end—preferably of a sharp-edged configuration—which viewed in the push-in direction is arranged displaced rearwardly with respect to the connecting location between the tongue and bar portion. In that way the tongue can be pushed into place in the insertion direction but the tongue cannot be pulled out in the opposite direction.

In a development of the invention it can be provided that there is a release device, by which at least one tongue can be released from the arresting position.

The article of furniture according to the invention is characterised by at least one drawer of the kind in question.

BRIEF DESCRIPTION OF THE DRAWINGS

Further details and advantages of the present invention are described by means of the embodiment by way of example shown in the Figures in which.

DETAILED DESCRIPTION

Figure 1:
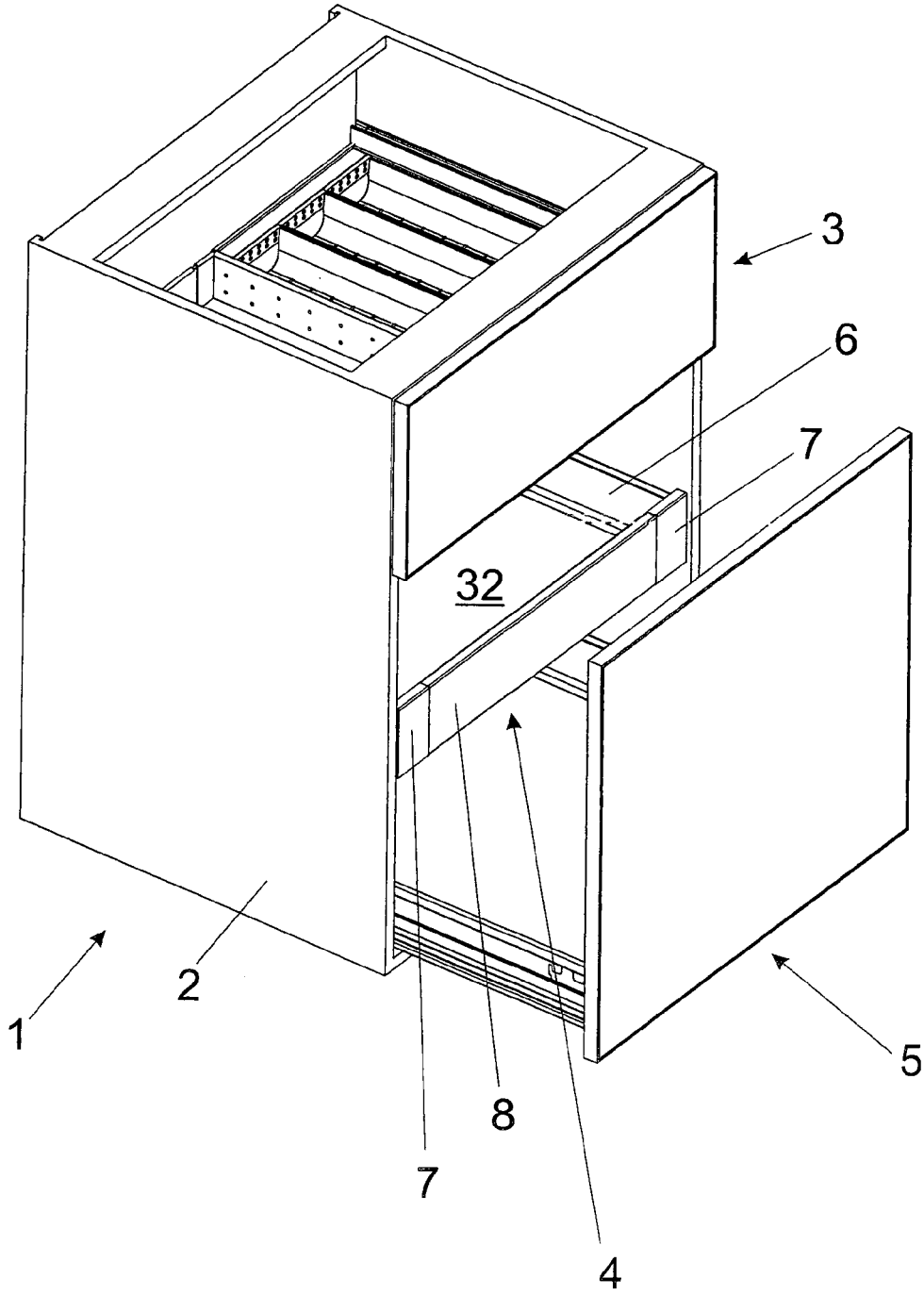
FIG. 1 shows a perspective view of an article of furniture in cabinet form, wherein the two wall portions to be connected jointly form a front wall of an internal extension drawer.

FIG. 1 shows a perspective view of an article of furniture 1 comprising a furniture carcass 2, wherein drawers 3, 4, 5 are supported displaceably relative to the furniture carcass 2. The central drawer 4 is in the form of an internal extension drawer 4 which in the closed position is concealed by the upwardly extended front panel of the lower drawer 5. The drawer 4 has drawer side walls 6, a drawer bottom 32 and a front wall which in the illustrated embodiment is composed of lateral first wall portions 7 and a second wall portion 8 disposed therebetween.

Figure 2:
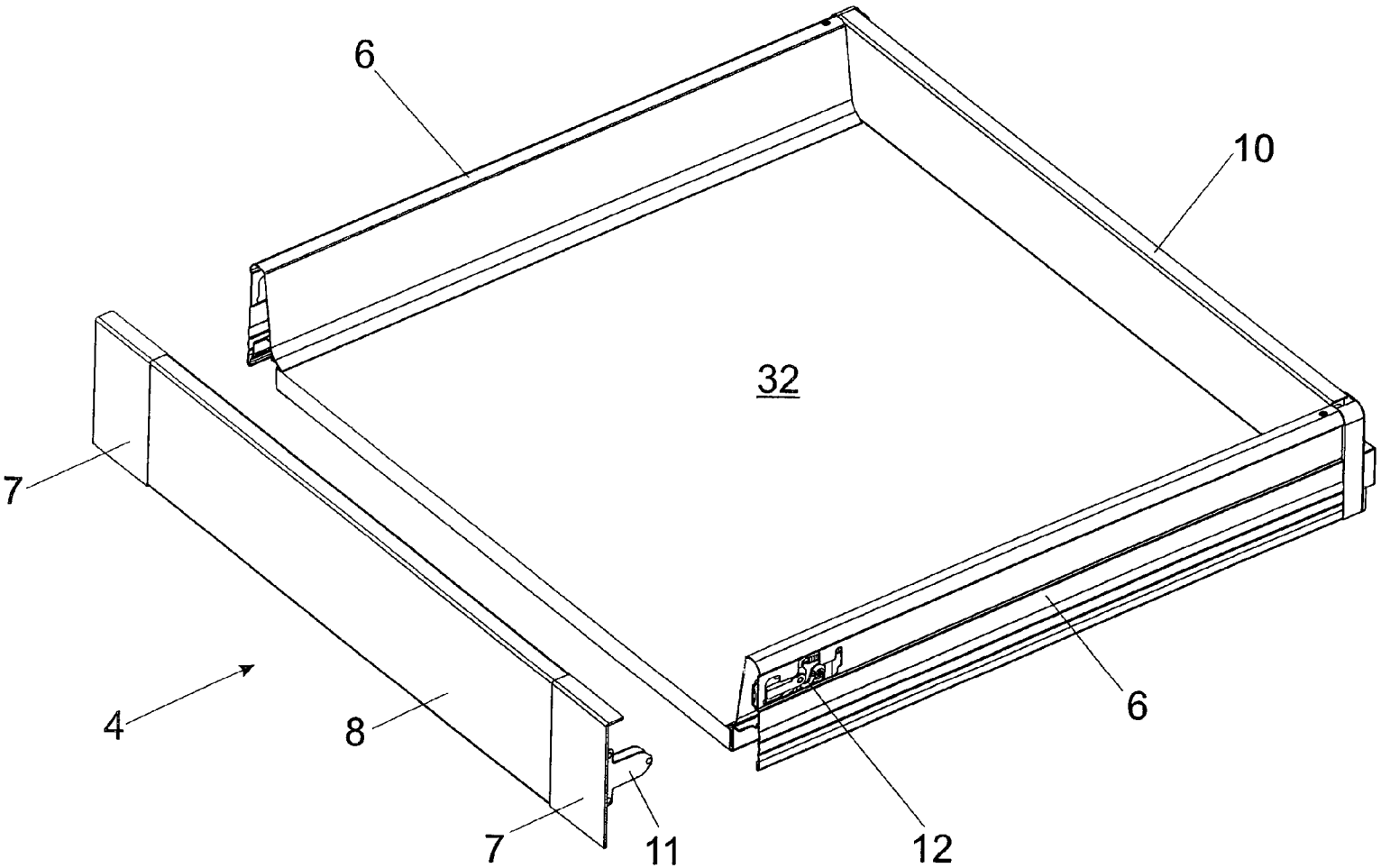
FIG. 2 shows the drawer in the form of the internal drawer extension, with the front wall not yet fixed in place.

FIG. 2 shows the drawer 4 in the form of the internal extension drawer as shown in FIG. 1. It has drawer side walls 6, a drawer bottom 32 and a rear wall 10. The front wall of the drawer 4 includes two lateral first wall portions 7 which are each to be connected to a second wall portion 8 by way of a fixing device 15 that is still to be described. The wall portions 7, 8 jointly form a drawer wall portion which extends substantially straight, in the present case in form of the front wall. The first wall portions 7 each have at least one holding portion 11 on the rear side, wherein the holding portions 11 can be releasably latched with a latching device 12 of the drawer side wall 6.

Figure 3:
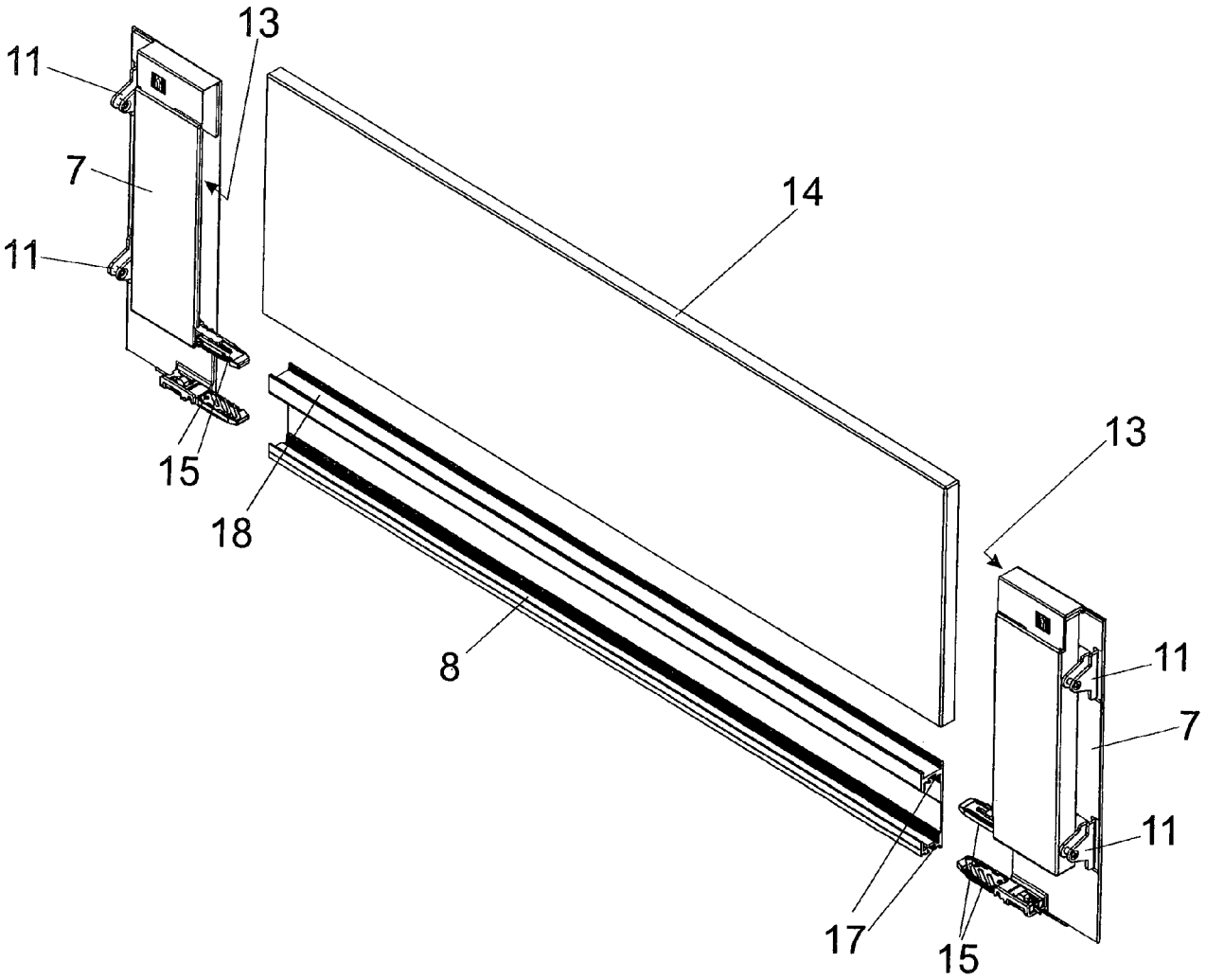
FIG. 3 shows the front wall of the drawer in a disassembled condition, formed from first and second wall portions.

FIG. 3 shows the wall portions 7, 8 in a slightly modified embodiment. In the illustrated embodiment, the two first wall portions 7 include two holding portions 11 which are spaced in a heightwise direction and which can be respectively releasably latched in separate latching devices 12 (FIG. 1) of the drawer side wall 6. The wall portions 7 are respectively provided with an insertion pocket 13 for receiving a plate-shaped wall portion 14, wherein the plate-shaped wall portion 14 can be in the form of a decorative insert of glass, wood, metal, plastic or ceramic. Arranged at the wall portions 7 are respective vertically spaced fixing devices 15 which respectively have—preferably spring-elastic—tongues 16*a* (FIG. 5*b*) which can be respectively inserted at the ends in openings 17 in the second wall portion 8 and can be clampingly fixed therein. At the top side the second wall portion 8 has a—preferably U-shaped—channel 18 into which the plate-shaped wall element 14 can be fitted with its lower longitudinal edge.

Figure 4:
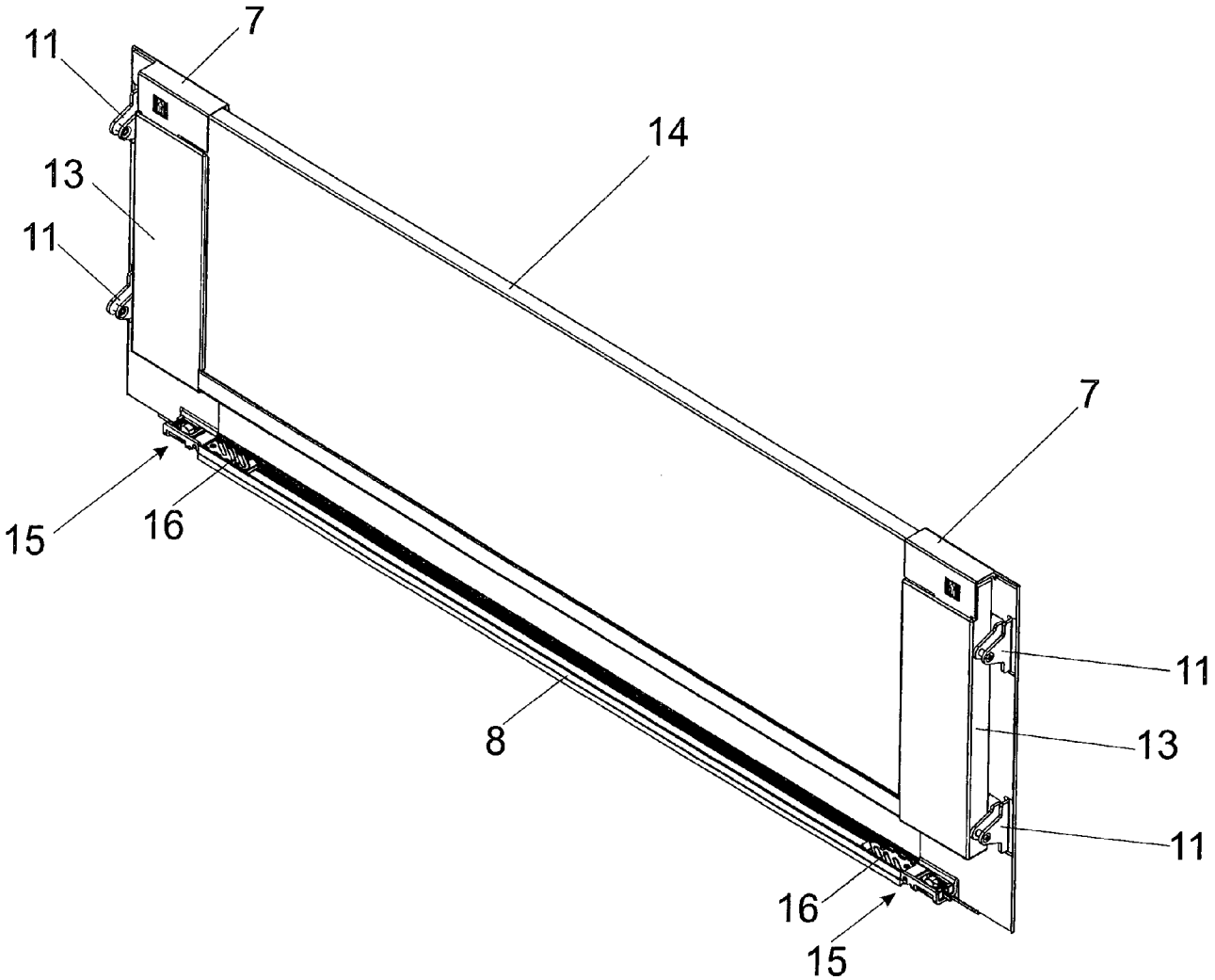
FIG. 4 shows a perspective view of the interconnected wall portions.

FIG. 4 shows the wall portions 7 and 8 in the interconnected condition, with the plate-shaped wall element 14 being received between therebetween. For improved fixing of the wall portions 7, 8, it can be provided that each fixing device 15 has an arresting element 16 which includes two or more tongues 16*a* (FIG. 5*b*) spaced in the longitudinal direction of the wall portion 8, wherein the tongues 16*a* in the fitted condition respectively bear against a flank of the openings 17 (FIG. 2)—preferably under their own elasticity.

Figure 5A:
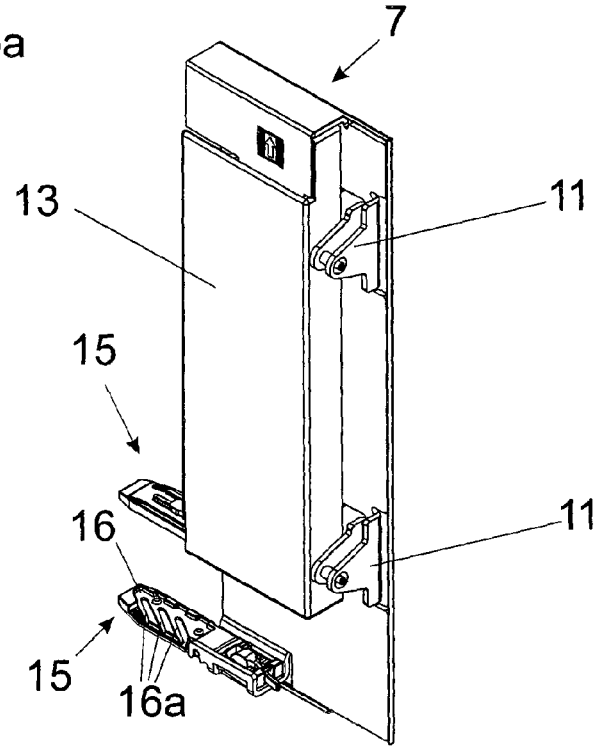
FIGS. 5*a* and 5*b* show a perspective view of a first wall portion and the two wall portions to be connected together.

FIG. 5*a* shows a perspective view of the first wall portion 7. It is possible to see the insertion pocket 13 which is provided thereon and which is intended to receive an end region of the plate-shaped wall element 14. The two holding portions 11 serve to fix the wall portion 7 relative to the drawer side wall 6. The two fixing devices 15 spaced in the heightwise direction of the wall portion 7 can provide for a tilt-resistant connection between the two wall portions 7, 8. The fixing devices 15 each have an arresting element 16 with at least two or more tongues 16*a*.

Figure 5B:
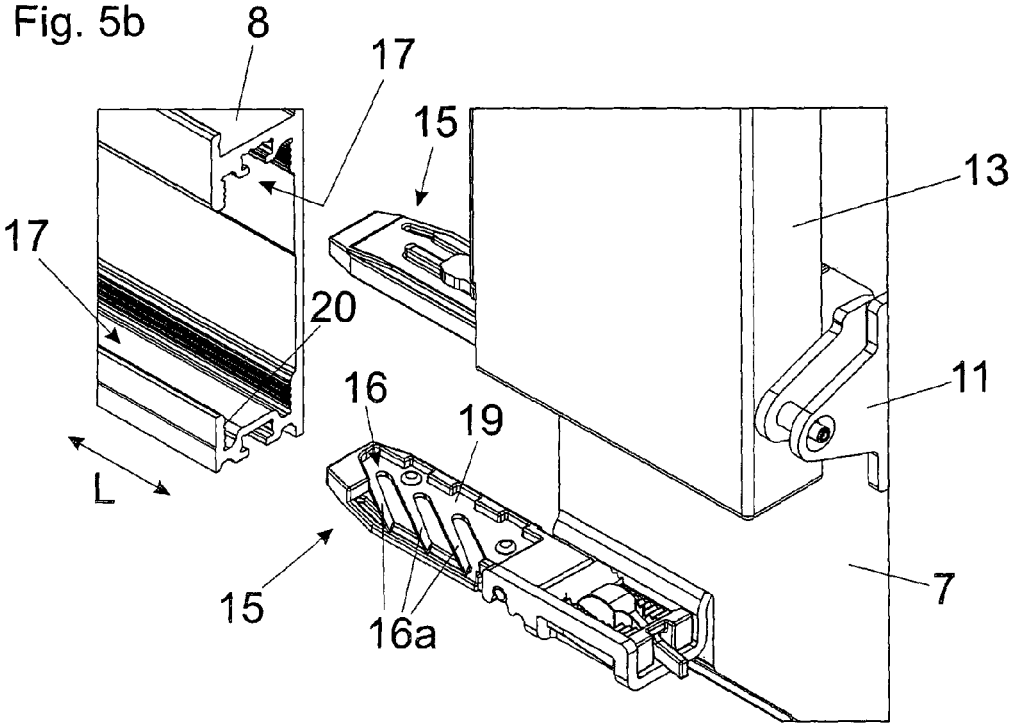

FIG. 5*b* shows a part of the first wall portion 7 and an end region of the second wall portion 8 as a perspective view on an enlarged scale. The opening 17 of the second wall portion 8 has a longitudinal extent (L), wherein the longitudinal direction of the tongues 16*a* extends inclinedly relative to the longitudinal extent (L) of the opening 17. It is possible to see an arresting element 16 which is of a substantially comb-like configuration and which has a bar portion 17 and a plurality of tongues 16*a* which are spaced in the longitudinal direction of the bar portion 19 and which project laterally from the bar portion 19. The tongues 16*a* respectively have a free end—preferably of a sharp-edged configuration—which points rearwardly in the direction of insertion of the tongues 16*a*. The tongues 16*a* are formed from metal—preferably in one piece with the arresting element 16. In the illustrated embodiment, the opening 17 in the wall portion 8 is in the form of a groove extending in the longitudinal extent (L) of the wall portion 8. Upon assembly, the tongues 16*a* are pushed into the opening 17 and in that case bear against a flank 20 of the opening 17.

Figure 6A:
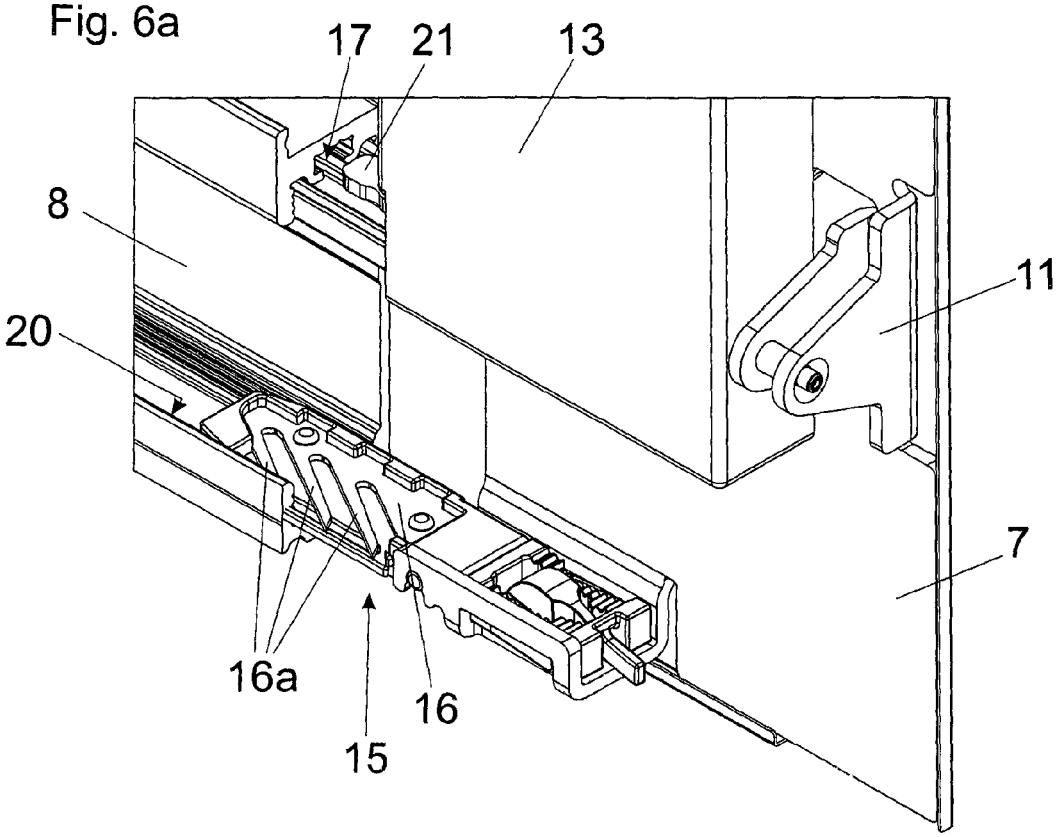
FIGS. 6*a* and 6*b* show the two wall portions to be connected together, wherein the tongues of the arresting element are partially pushed into the opening in a wall portion, and a wall portion having a fixing device in a further embodiment.

FIG. 6*a* partly shows the first wall portion 7 and the second wall portion 8, wherein the tongues 16*a* of the fixing device 15 are partially pushed into a lower opening 17 of the second wall portion 8. The sharp-edged free ends of the tongues 16*a* bear in that case constantly against a flank 20 of the lower recess 17. The upper recess 17 of the second wall portion 8 is in the form of a profile groove, in which respect it may also be sufficient for only one push-in projection 21 to be inserted into the upper opening 17.

Figure 6B:
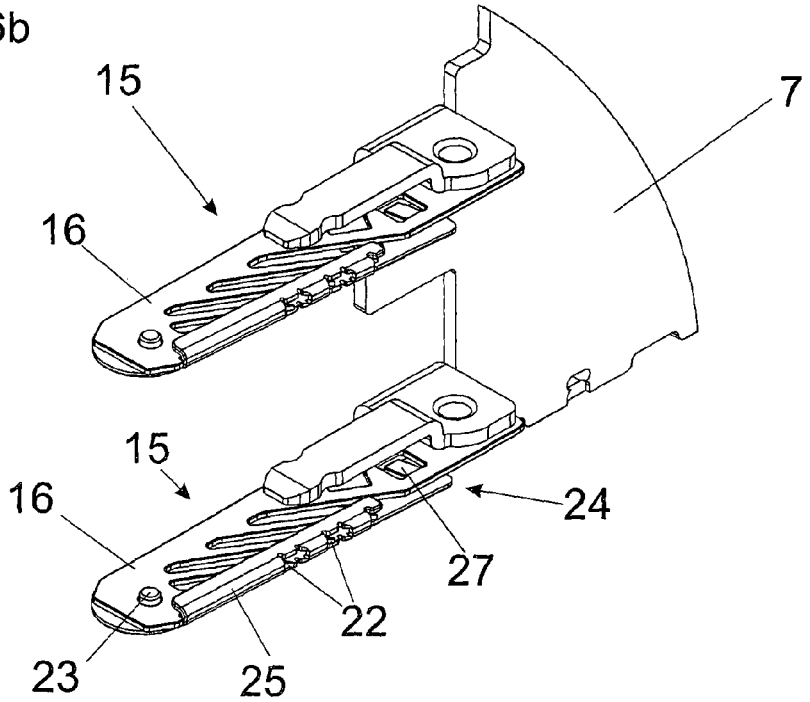

FIG. 6*b* shows a partial region of the first wall portion 7 with the vertically spaced fixing devices 15. A particularity to be mentioned is a release device 24 by which the tongues 16*a* are releasable from the arresting position. The release device 24 includes a lever 25 to be actuated by a person, in which case, by actuation of the lever 25, the tongues 16*a* are movable from the arresting position, preferably in opposition to the spring-elastic action of the tongues 16*a*, into a release position in which the clamping fixing of the two wall portions 7, 8 is removed and the wall portions 7, 8 are separable from each other. The lever 25 is mounted pivotably about the axis 23 and performs a further purpose, namely it embraces the tongues 16*a* in such a way that only the tips 22 of the tongues 16*a* project slightly laterally. In that way the risk of injury to people or damage to objects can be substantially eliminated. The lever 25 can be pivoted—for example with a screwdriver—about the axis 23 in opposition to the resilient force of the tongues 16*a*, whereby the tips 22 of the tongues 16*a* are urged back and no longer bear against the flank 20 of the opening 17 so that the wall portions 7, 8 can therefore be separated from each other. So that a person in separating the two wall portions 7, 8 does not have to continuously apply a force against the resilient action of the tongues 16*a* there is provided a holding device 27 by which the lever 25 can be held in the release position. As shown in the Figure, the holding device 27 can have a projection 30 (FIG. 7*b*) which is provided on the arresting element 16 and which in the release position releasably latches in a corresponding aperture 31 (FIG. 7*b*) in the lever 25. By suitable actuation of the lever 25, the projection 30 can be disengaged from the opening 31 again, whereupon the tongues 16*a* automatically spring back into the arresting position again.

Figure 7B:
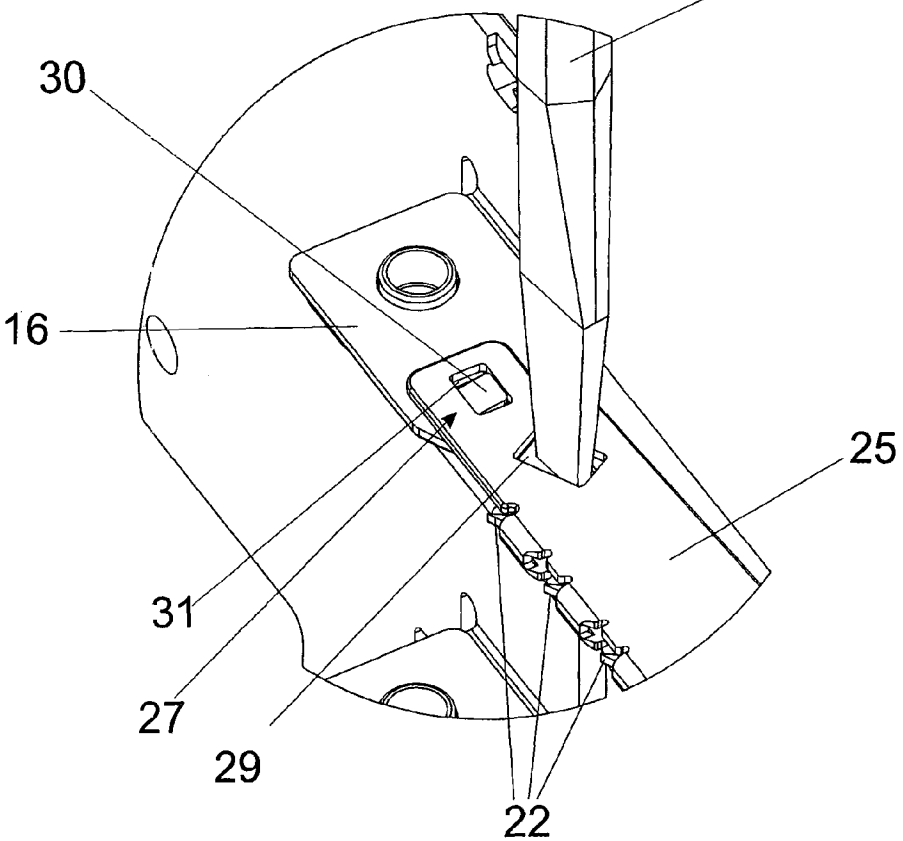
FIGS. 7*a* and 7*b* show perspective views of the first wall portion and as an enlarged detail view of the wall portion, wherein the two wall portions are separable from each other by a release device.
Figure 7A:
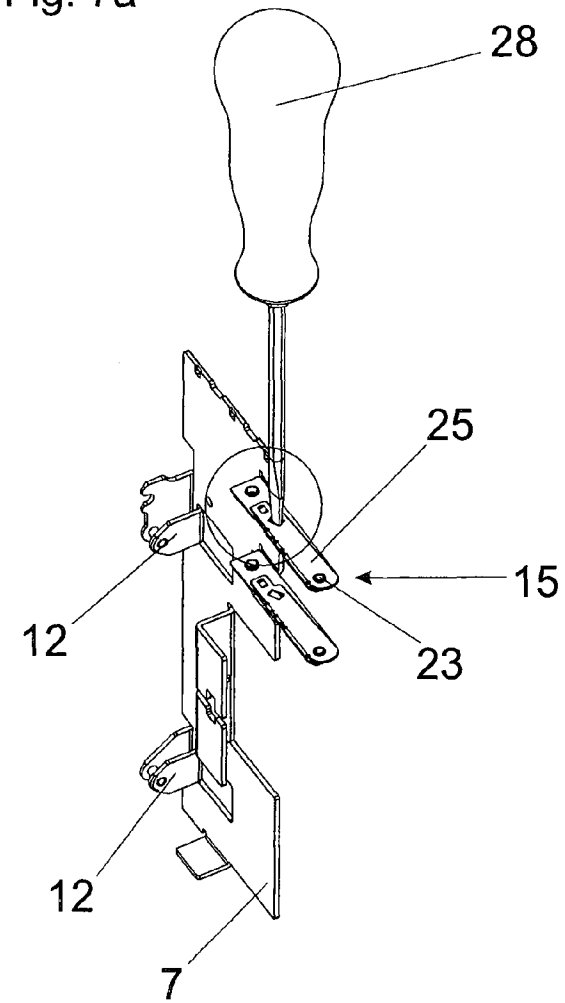

FIG. 7*a* shows a perspective view from below of the first wall portion 7, wherein the lever 25 is movable by a screwdriver 28 about the axis 23 against the resilient action of the tongues 16*a* into a release position so that the tongues 16*a* are no longer arrested within the opening 17. FIG. 7*b* shows an enlarged view of the region circled in FIG. 7*a*. The lever 25 has a receiving means 29 for the screwdriver 28, in which case the lever 25 is pivoted by a rotary movement of the screwdriver 28 in opposition to the resilient action of the tongues 16*a* about the axis 23 so that the tips 22 of the tongues 16*a* are pushed back until the projection 30 of the arresting element 16 latches in a corresponding opening 31 of the lever 25 and thus holds the tips 22 in a release position spaced from the flank 20. The projection 30 can be disengaged from the opening 31 again by an opposite rotary movement of the screwdriver 28 so that the tongues 16*a* automatically spring back into the arresting position.

The present invention is not limited to the illustrated embodiment but includes or extends to all variants and technical equivalents which can fall within the scope of the appended claims. The positional references adopted in the description such as for example up, down, lateral and so forth are also related to the directly described and illustrated Figure and are to be appropriately transferred to the new position upon a change in position.

The invention claimed is:

1. A drawer comprising:

a first wall portion;

a second wall portion;

an opening comprising a groove and a flank on the second wall portion, wherein the groove and the flank extend in a longitudinal direction;

a fixing device connected to the first wall portion for connecting the first wall portion to the second wall portion; and a release device by which at least one tongue is releasable from bearing against the flank, said release device having a lever to be actuated by a person, wherein by actuation of the lever the at least one tongue is movable by the releasing device starting from an arresting position in an opposite direction of the resiliency of the tongue into a release position at which the at least one tongue is released from bearing against the flank whereby the wall portions are separable from each other;

wherein the fixing device has an arresting element which includes a bar portion and a plurality of tongues which are spaced in a longitudinal direction of the bar portion and which project laterally from the bar portion such that each tongue has a free end and such that each tongue is resilient;

wherein in a connected condition of the first and second wall portions, at least part of the fixing device is inserted in the groove of the opening of the second wall portion such that the arresting element is oriented so that the plural tongues are spaced in the longitudinal direction of the groove and the flank and such that the free ends of the plural tongues bear against the flank of the opening due to resiliency of the tongues.

2. The drawer according to claim 1, wherein at least one tongue is of a spring-elastic configuration.

3. The drawer according to claim 1, wherein at least one tongue has a longitudinal direction extending at an angle relative to a longitudinal extent of the opening.

4. The drawer according to claim 1, wherein the free end of at least one tongue is displaced rearwardly with respect to a pushing-in direction relative to the connecting location between the at least one tongue and the bar portion.

5. The drawer according to claim 1, wherein the free end of at least one tongue has a sharp edge.

6. The drawer according to claim 1, wherein at least one tongue is held in self-arresting relationship within the opening.

7. The drawer according to claim 1, wherein at least one tongue is formed from metal.

8. The drawer according to claim 1, wherein at least one tongue and said bar portion of the arresting element are of a one-piece configuration.

9. The drawer according to claim 1, wherein the groove and flank extend to the longitudinal extent of the second wall portion.

10. The drawer according to claim 1, wherein the fixing device has a holding device by which the lever can be held in the release position.

11. The drawer according to claim 1, wherein the first wall portion and the second wall portion jointly form a drawer wall portion which extends substantially straight.

12. The drawer according to claim 1, wherein one of the first and second wall portions has at least one holding portion which can be releasably latched in a latching device of a drawer side wall.

13. An article of furniture comprising at least one drawer according to claim 1.

* * * * *